US005260984A

United States Patent [19]

Horbaschek

[11] Patent Number: 5,260,984

[45] Date of Patent: Nov. 9, 1993

[54] X-RAY DIAGNOSTICS INSTALLATION HAVING A PRIMARY RADIATION DIAPHRAGM

[75] Inventor: Heinz Horbaschek, Erlangen, Fed. Rep. of Germany

[73] Assignee: Siemens Aktiengesellschaft, Munich, Fed. Rep. of Germany

[21] Appl. No.: 833,198

[22] Filed: Feb. 10, 1992

[30] Foreign Application Priority Data

Mar. 1, 1991 [DE] Fed. Rep. of Germany ..... 4106596

[51] Int. Cl.[5] ..... G21K 1/02

[52] U.S. Cl. ..... 378/150; 378/99; 378/147

[58] Field of Search ..... 378/147, 150, 99

[56] References Cited

FOREIGN PATENT DOCUMENTS 1800879 1/1974 Fed. Rep. of Germany .

OTHER PUBLICATIONS

Siemens Brochure for Angiostar ®—Universal System for Indirect and Direct Techniques.

*Primary Examiner*—Craig E. Church

*Attorney, Agent, or Firm*—Hill, Steadman & Simpson

[57] ABSTRACT

An x-ray diagnostics installation having a primary radiation diaphragm disposed in the beam path of an x-ray tube includes a control unit for the primary radiation diaphragm having an operator-manipulable setting element and associated circuitry which cause the primary radiation diaphragm to move in directions corresponding to the direction of movement of the setting element. Rotary motion of the setting element causes rotation of the primary radiation diaphragm, and pivoting of the setting element cause the primary radiation diaphragm to be moved in the corresponding direction of the pivot.

9 Claims, 2 Drawing Sheets

X-RAY DIAGNOSTICS INSTALLATION HAVING A PRIMARY RADIATION DIAPHRAGM

BACKGROUND OF THE INVENTION

1. Field of the Invention

The present invention is directed to an x-ray diagnostics installation of the type having a primary radiation diaphragm disposed in the beam path of an x-ray tube, and control means for setting the position of the primary radiation diaphragm.

2. Description of the Prior Art

In x-ray diagnostics systems which result in the production of an x-ray image and/or a visible image corresponding to the x-ray image, the position of the primary radiation diaphragm, or the position of beam-interacting elements thereof, is adjustable for various purposes, such as for selecting the contour of the examination region which will appear in the image. For example, a heart contour diaphragm can be used in a so-called depth diaphragm top achieve a primary reduction in the contrast between the mediastinum (heart shadow) and the adjoining lung field for improving the image quality or for avoiding halations (glare) in the video image. The diaphragm can be adjusted to produce a straight contour, concave or convex shapes, or a wedge shape.

A primary radiation diaphragm of this type is disclosed in German Patent 1 800 879 for use in an x-ray exanination apparatus, wherein two lamellae can be moved toward and away from each other by actuating keys. The lamellae are mounted on a rotatable carrier, which can be rotated by means of a further operating key. The respective keys which control these different movements are identical, so that mistakes can easily occur.

More recently, a joystick has been predominantly used to control the operation of the primary radiation diaphragm as described, for example, in the brochure for the "ANGIOSTAR ®", manufactured by Siemens AG. Pivoting the joystick toward the right or the left respectively causes an introduction of the diaphragm plates into the image, or a withdrawal of the diaphragm plates from the image. Movement of the joystick toward the front or rear results in a rotation of the entire diaphragm. Such operation of the joystick, however, is not ergonometric, and mistakes again can easily occur.

SUMMARY OF THE INVENTION

It is an object of the present invention to provide an x-ray diagnostics installation having a primary radiation diaphragm which is operable in a simple and ergonometric manner.

The above object is achieved in accordance with the principles of the present invention in an x-ray diagnostics installation having a control unit for the primary radiation diaphragm with an operator-manipulable setting element which controls the control unit so that the type of motion of the setting element corresponds to the type of motion which the primary radiation diaphragm is caused to undergo by the operation of the setting element. The desired position of the primary radiation diaphragm can thus be set in a simple manner, by operating the setting element in a way which corresponds to the desired motion of the primary radiation diaphragm. Mistakes in the operation of the primary radiation diaphragm are thereby reduced.

Preferably the setting element is in the form of an operating lever provided with a cap, the operating lever being pivotable in all directions in the manner of a joystick, and being rotatable by means of the cap, with a rotary motion of the setting element effecting a rotation of the primary radiation diaphragm, and a pivoting of the setting element effecting movement of the primary radiation diaphragm in a direction corresponding to the pivoting direction. As a result of movement of the operating lever in one of the directions, the primary radiation diaphragm will move in the same direction, and a rotation of the primary radiation diaphragm is achieved by rotating the cap.

By making the motion of the primary radiation diaphragm in the video image coincide with the motion of the setting element, it is not necessary for the operating personnel to "reinterpret" the motion of the diaphragm as correlated with the operation of the control means by the setting element.

The visibility of the primary radiation diaphragm in the video image is enhanced in an embodiment wherein the control means is connected to a processing circuit which causes a line corresponding to the contour of the primary radiation diaphragm (or a beam-interacting element thereof), to be mixed in the video image upon actuation of the setting element. The radiation load on the attending personnel can be reduced by connecting the control means to the high-voltage generator which feeds the x-ray tube, with the control means reducing the dose of the x-ray generator upon actuation of the setting element. The setting can then take place with a reduced radiation dose, since a qualitatively high-grade x-ray image is not required during the setting.

Further setting functions can be combined with the above-described embodiments by mounting the operating lever so that it can be pressed and/or pulled. For example, adjustment of an iris diaphragm arranged in an optics system can be effected in this manner with pressing/pulling of the operating lever causing opening/closing of the iris diaphragm. The position of the evaluation dominant can be taken into consideration when adjusting the primray radiation diaphragm in an embodiment wherein the position of the evaluation dominant is mixed in the video image when the setting element is actuated.

DESCRIPTION OF THE PREFERRED EMBODIMENTS

Figure 1:
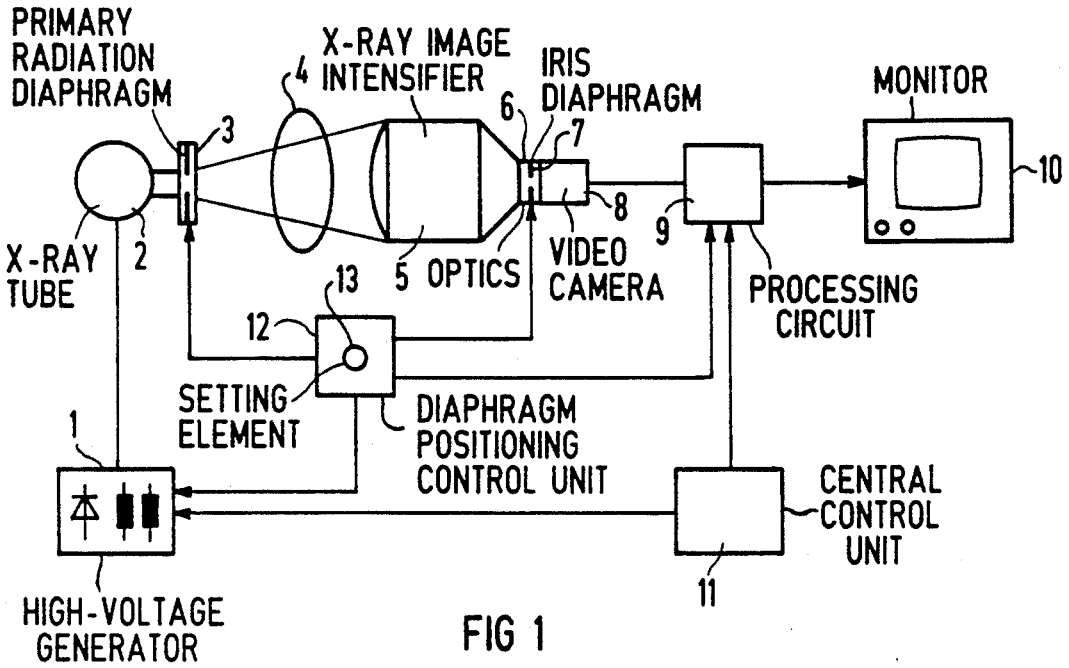
FIG. 1 is a schematic block diagram of an x-ray diagnostics installation constructed in accordance with the principles of the present invention.

An x-ray diagnostics installation constructed in accordance with the principles of the present invention is shown in FIG. 1, which includes an x-ray tube 2 fed by a high-voltage generator 1. The x-ray tube 2 is provided with a primary radiation diaphragm 3, for example, a heart contour diaphragm. The x-ray tube 2 generates an x-ray beam which is limited by the primary radiation diaphragm 3 (i.e., by the beam-interacting elements thereof). The x-ray beam as limited by the primary radiation diaphragm 3 penetrates a patient 4, and the attenuated radiation is incident on an input screen of an x-ray image intensifier 5. The incident radiation image is intensified and is reproduced on the output screen of the x-ray image intensifier 5, from which it is imaged on the target of a video camera 8 by means of optics 6 having an iris diaphragm 7. A processing circuit 9 is connected to the video camera 8, the processing circuit 9 being connected to a monitor 10 for displaying the x-ray image in visible form. The processing circuit 9 may include a transducer, an image store and calculating units operating in a known manner. Synchronization of the various components of the installation of FIG. 1 is undertaken by a central control unit 11.

Figure 2:
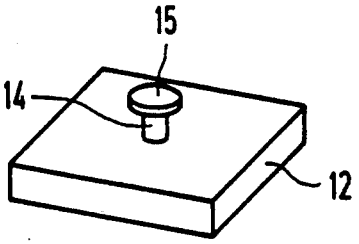
FIG. 2 is a perspective view of a control unit constructed in accordance with the principles of the present invention for use in the installation shown in FIG. 1.

A diaphragm positioning control unit 12 having a setting element 13 (shown in greater detail in FIG. 2) is connected to the primary radiation diaphragm 3. The control unit 12 consists of a control box to which an operating lever 14 provided with a cap 15 is attached, the operating lever 14 and the cap 15 being in the shape of a mushroom knob.

In the manner of a joystick, the operating lever 14 can be pivoted in all directions, and it can be rotated by its cap 15. Additionally, the operating lever 14 can be pressed or pulled by grasping the cap 15, as described below.

Figure 3:
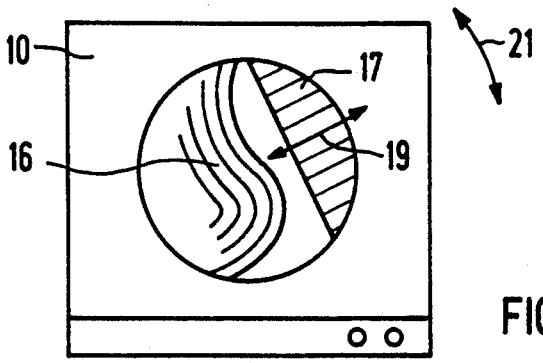
FIG. 3 is a simplified representation of a displayed image obtained in the installation of FIG. 1, correlated with setting element movements as shown in FIG. 4.
Figure 4:
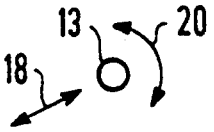

The monitor 10 on which the image of a heart 16 is schematically portrayed is shown in FIG. 3. A diaphragm plate 17 of the primary radiation diaphragm 3 is also seen in the image. The setting element 13 is schematically shown in FIG. 4. When the setting element 13 is moved or pivoted in one of the directions of the double arrow 18, the diaphragm plate 17 is moved in a corresponding direction, as indicated by the double arrow 19. When the operating lever 14, for example, is pivoted toward the bottom left in the direction of the double arrow 18, this results in the primary radiation diaphragm 3 becoming more closed, because the diaphragm plate 17 moves toward the contour of the heart 16 toward the bottom left in the direction of the double arrow 19. If pivoting of the primary radiation diaphragm is required, this is undertaken buy a rotational motion of the setting element 13 in the direction of the double arrow 20, which causes a rotation of the primary radiation diaphragm 3, and thus of the diaphragm plate 17 in the direction of the double arrow 21.

Figure 5:
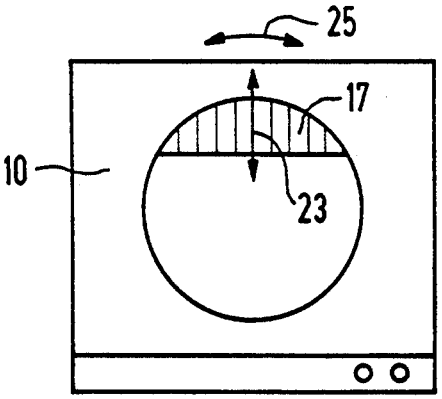
FIG. 5 is another simplified representation of a displayed image obtained in the installation of FIG. 1, correlated with setting element movements as shown in FIG. 6.
Figure 6:
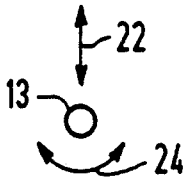

A further example is shown in a similar manner in FIGS. 5 and 6. The diaphragm plate 17 in this example is situated in the upper region of the video image. For example, this could be effected by moving the diaphragm plate from the position shown in FIG. 3 by turning the setting element 13 toward the left. Pivoting of the setting element 13 in the direction of the double arrow 22 then causes the primary radiation diaphragm 3 to open or close, by moving the diaphragm plate 17 in a corresponding direction of the double arrow 23. Rotational motion according to the double arrow 24 causes the primary radiation diaphragm 3 to execute a rotational motion conforming to the double arrow 25.

It is thus insured that the alignment of the primary radiation diaphragm 3 and the video image thereof on the monitor 10 will agree during setting of the primary radiation diaphragm 3, so that the attending personnel can identify by visual contact the direction in which the primary radiation diaphragm 3 is to be moved, and can implement a corresponding operation via the setting element 13.

As shown in FIG. 1, the control unit 12 can also be connected to the high-voltage generator 1. Each actuation of the setting element 13 supplies a control signal to the high-voltage generator 1, which reduces the radiation dose in the transillumination mode in response thereto, so the patient 4 receives a lower radiation load during the setting of, for example, the heart contour diaphragm as the primary radiation diaphragm 3. Such setting can be undertaken with a reduced does because high-quality x-ray images are not required during setting, since no diagnosis is undertaken.

The control unit 12 can also be connected, for example, to the processing circuit 9, causing a line representing the edge of the diaphragm plate 17 to be mixed into the video image. Actuation of the setting element 13 may also initiate an automatic gain control so that, for example, the brightness of the video image remains the same given the reduced dose.

The control unit 12 can also be connected to the iris diaphragm 7 disposed in the optics 6. Operation of the iris diaphragm 7 can be undertaken by pressing and pulling the setting element 13. For example, pressing on the operating lever 14 can close the iris diaphragm 7, and pulling on the cap 15 can open iris diaphragm 7.

Instead of only one operating lever 14 having a plurality of functions, a plurality of operating levers can alternatively be provided as the setting element, with the respective functions being divided among these operating levers. Thus, a first operating lever, by its pivot motion, can move the diaphragm plate 17 to open and close the diaphragm 3, with a second operating lever effecting rotation of the diaphragm plate 17 in the direction of the double arrows 21 or 25 by rotating such a second lever toward the right or the left against a detent.

Even more functions can be integrated in the operating lever 14. For example, pivoting of the setting element 13 in a direction substantially perpendicular to the double arrows 22, i.e., toward the right for example, can cause a rotary motion of the diaphragm plate 17 in the direction of the double arrows 25 toward the left, until the edge of the diaphragm plate 17 is disposed perpendicularly relative to the direction of the pivoting of the setting element 13. Closing or opening of the diaphragm 3 by means of moving the diaphragm plate 17 can be subsequently undertaken by another actuation of the setting element in the desired direction.

The control of the diaphragm plate 17 from the position shown in FIG. 5, however, can also be achieved by pivoting the setting element in a desired direction of the double arrow 22 takes place first up to a detent, with the setting element being subsequently pivoted in the direction of the double arrow 24. A rotation in the direction of the double arrow 25 and a subsequent closing of the diaphragm plate 17 will then occur.

The x-ray diagnostics installation disclosed herein provides an ergonometric operation of the primary radiation diaphragm which is based on operating possibilities which unambiguously correspond to the displayed image. A rotary motion of the setting element 13 in the form of a mushroom knob is implemented for rotating the primary radiation diaphragm 3 and a tilting or pivoting motion of the setting element 13 in the desired direction is implemented for introduction and withdrawal of the diaphragm plates in directions perpendicular to an axis through the center of the image.

Regardless of the individual geometrical conditions of the x-ray apparatus, the video image, from the standpoint of the operator, is the only reference point which must be observed in order to correctly and accurately position the elements of the primary radiation diaphragm 3.

Although modifications and changes may be suggested by those skilled in the art, it is the intention of the inventor to embody within the patent warranted hereon all changes and modifications as reasonably and properly come within the scope of his contribution to the art.

We claim as our invention:

1. An X-ray diagnostics installation comprising:

An X-ray tube which generates an X-ray beam in a beam path;

A primary radiation diaphragm disposed in said beam path and having at least one moveable element which can assume different orientations; and Control means for positioning said moveable element is said beam path including user-manipulable setting means, consisting of an operating lever having a free end with a cap and said operating lever being pivotable in all directions and rotatable by said cap, for operating said control means for causing said moveable element to execute a motion corresponding to motion of the second means for all orientations of said moveable element.

2. An x-ray diagnostics installation as claimed in 1 further comprising means for generating a video image of an examination subject disposed in said x-ray beam, and means, upon actuation of said setting means, for mixing the position of an evaluation dominant into said video image.

3. An x-ray diagnostics installation as claimed in claim 1 wherein said setting means is rotatable for effecting a rotary motion of said movable element.

4. An x-ray diagnostics installation as claimed in claim 1 wherein said setting means is pivotable for effecting a movement of said movable element in a direction corresponding to the direction of the pivot.

5. An x-ray diagnostics installation as claimed in claim 1 further comprising means for displaying a video image of an examination subject disposed in said beam path, and means for displaying said movable element of said primary radiation diaphragm in said video image so that movement of said movable element in said video image coincides with movement of said setting means.

6. An x-ray diagnostics installation as claimed in claim 5 further comprising processing means, connected to said control means, for, upon actuation of said setting means generating a line corresponding to a contour of said movable element mixed in said video image.

7. An x-ray diagnostics installation as claimed in claim 1 further comprising high-voltage means for feeding said x-ray tube, and further comprising means for reducing the dose of said x-ray tube upon actuation of said setting means.

8. An x-ray diagnostics installation as claimed in claim 1 wherein said operating lever is mounted so as to be pressable and pullable.

9. An x-ray diagnostics installation as claimed in claim 8 further comprising an optics system in video chain for generating a visible image of an examination subject disposed in said beam path, said optics system including an iris diaphragm, and wherein said iris diaphragm is connected to said control means so that pressing and pulling of said operating lever respectively opens and closes said iris diaphragm.

* * * * *